US008042199B2

(12) United States Patent
Chiang

(10) Patent No.: US 8,042,199 B2
(45) Date of Patent: Oct. 25, 2011

(54) SWIMMING GOGGLES

(76) Inventor: Herman Chiang, Chung-Ho (TW)

( * ) Notice: Subject to any disclaimer, the term of this patent is extended or adjusted under 35 U.S.C. 154(b) by 788 days.

(21) Appl. No.: 12/155,026

(22) Filed: May 29, 2008

(65) Prior Publication Data

US 2009/0276942 A1 Nov. 12, 2009

(30) Foreign Application Priority Data

May 8, 2008 (TW) ..... 97207983 U

(51) Int. Cl.
*A61F 9/02* (2006.01)

(52) U.S. Cl. ..... 2/448

(58) Field of Classification Search ..... 2/426, 428, 2/445, 448, 450; 351/41, 43
See application file for complete search history.

(56) References Cited

U.S. PATENT DOCUMENTS 6,112,334 A * 9/2000 Chiang ..... 2/428
6,961,965 B2 * 11/2005 Chiang ..... 2/445
7,185,373 B2 * 3/2007 Chiang ..... 2/445
7,251,842 B1 * 8/2007 Chiang ..... 2/445

* cited by examiner

*Primary Examiner* — Katherine Moran
(74) *Attorney, Agent, or Firm* — Cheng-Ju Chiang

(57) ABSTRACT

Swimming goggles are provided which have a frame unit, buckle units and a head strap assembled on the buckle units. The frame unit includes a left frame and a right frame respectively around a user's eyes, a connecting member detachably connecting the left frame and the right frame, and lenses assembled on the left frame and the right frame. First connecting portions are provided on sides of the left frame and the right frame. Each buckle unit includes at least a base, and a second connecting portion for engaging to or disengaging from the first connecting portion. The base defines directing holes therein for guiding the head strap. The connecting member, the first connecting portions and the second connecting portions are able to be assembled and disassembled such that the connecting member and the buckle units are assembled to or disassembled from the left frame and the right frame.

11 Claims, 5 Drawing Sheets

SWIMMING GOGGLES

BACKGROUND OF THE INVENTION

1. Field of the Invention

The present invention relates to swimming goggles, and particularly to swimming goggles which have frames and lenses integrated with each other and which have detachable connecting member and buckle unit for facilitating replacement of the frames.

2. Relate Art

In terms of cooperation of frames and lenses, swimming goggles are generally of two types: implanting type and integrating type. As for the implanting type, lenses are implanted into and then integrated with frames when the frames are shaped. The integrating type is made by integrating the frames and the lenses directly. The lenses of the implanting type can not vary according to myopic extent, and otherwise, the lenses of the implanting type may vary according to myopic extent.

The lenses of some conventional implanting type goggles may vary according to myopic extent. However, most of users have two eyes with different myopic degrees, but the conventional implanting type goggles can not suit for the two eyes at the same time. On most occasions, the only choice is that lenses of the swimming goggles are the same, which can not cater for users' need obviously.

SUMMARY OF THE INVENTION

To overcome the shortcomings, an object of the present invention is to provide swimming goggles which have lenses with different myopic degrees and/or different styles and which have replaceable left/right frames.

Another object of the present invention is to provide swimming goggles which have detachable connecting member and buckle units for facilitating operation.

A further object of the present invention is to provide swimming goggles which facilitates adjustment of a head strap.

The swimming goggles comprise a frame unit, buckle units and a head strap assembled on the buckle units. The frame unit includes a left frame and a right frame respectively around a user's eyes, a connecting member detachably connecting the left frame and the right frame, and lenses respectively assembled on the left frame and the right frame. First connecting portions are provided on sides of the left frame and the right frame. Each buckle unit includes at least a base, and a second connecting portion for engaging to or disengaging from the first connecting portion. The base defines directing holes therein for guiding the head strap. The connecting member, the first connecting portions and the second connecting portions are able to be assembled and disassembled such that the connecting member and the buckle units are assembled to or disassembled from the left frame and the right frame.

DESCRIPTION OF THE PREFERRED EMBODIMENTS

Figure 1:
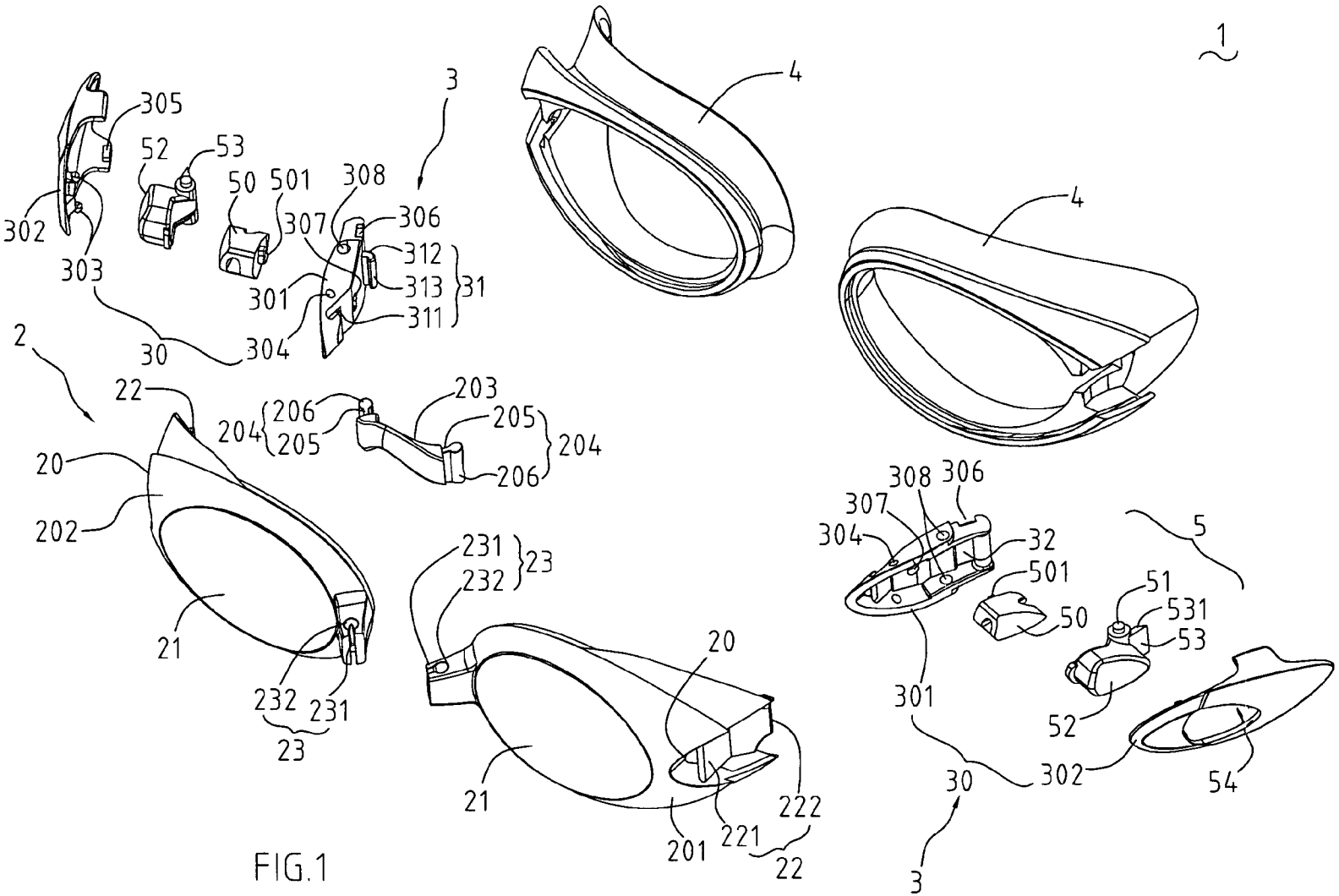
FIG. 1 is an exploded view of swimming goggles of the present invention.

With reference to FIG. 1, swimming goggles 1 in accordance with the present invention comprise a frame unit 2, buckle units 3, a head strap (not shown) and strap adjusting devices 5. The frame unit 2 includes a left frame 201 and a right frame 202 respectively around the eyes, lenses 21 assembled on and integrated with the left frame 201 and the right frame 202, first connecting portions 22 provided on sides of the left frame 201 and the right frame 202. The left frame 201 and the right frame 202 are made of Polypropylene (PP) material. Embedding grooves 23 are respectively defined in the left frame 201 and the right frame 202. Each embedding groove 23 has a notch 231 and a cylindrical engaging portion 232. A connecting member 203 detachably connects the left frame 201 and the right frame 202. Connecting posts 204 are respectively provided on opposite sides of the connecting member 203. Each connecting post 204 includes a neck 205 and a cylindrical expanding portion 206 extending from the neck 205. In assembly, the neck 205 and the expanding portion 206 are extended through the notch 231 for engaging to or disengaging from the engaging portion 232. Recessed portions 20 are respectively defined in outward sides of the left frame 201 and the right frame 202 for fitting to profiles of the buckle units 3 and assembling the buckle units 3.

The lenses 21 are respectively integrated with the left frame 201 and the right frame 202. Protective pads 4 are made of Thermal Plastic Rubber (TPR) and are unitarily formed on peripherals of the left frame 201 and the right frame 202 (referring to FIG. 2). Each first connecting portion 22 comprises a first latch and a second latch opposite to each other. In one embodiment, the first latch and the second latch are a first latching post 221 and a second latching post 222 which are respectively integrated with the left frame 201 and the right frame 202 and are respectively slantwise in relation to each other. In assembly, the first latch 221 and the second latch 222 are assembled on the recessed portions 20 of the left frame 201 and the right frame 202.

Each buckle unit 3 comprises a base 30, and a second connecting portion 31 for engaging to or disengaging from the first connecting portion 22. The base 30 includes a first cover 301 and a second cover 302. A branch 303 and an axis hole 304 cooperate to pivot first ends of the first cover 301 and the second cover 302. A locking portion 305 and a locking groove 306 connect second ends of the first cover 301 and the second cover 302. The first cover 301 defines a directing hole 32 for a head strap. The second cover 302 may be used as a panel of shaping. The second connecting portion 31 comprises a first embedding portion and a second embedding portion for respectively engaging to or disengaging from the first latch and the second latch. The first embedding portion comprises an latching groove 311 in the first cover 301 and corresponding to the first latching post 221. The latching groove 311 is slantwise for cooperating with the first latching post 221. The second embedding portion comprises a J-shaped post 312 formed on the first cover 301, the J-shaped post 312 forming a barb 313 for locking with the second latching post 222. The first cover 301 defines a rectangular fixing groove 307 and an axis slot 308 between the latching groove 311 and the J-shaped post 312 for assembling the strap adjusting devices 5.

Figure 3:
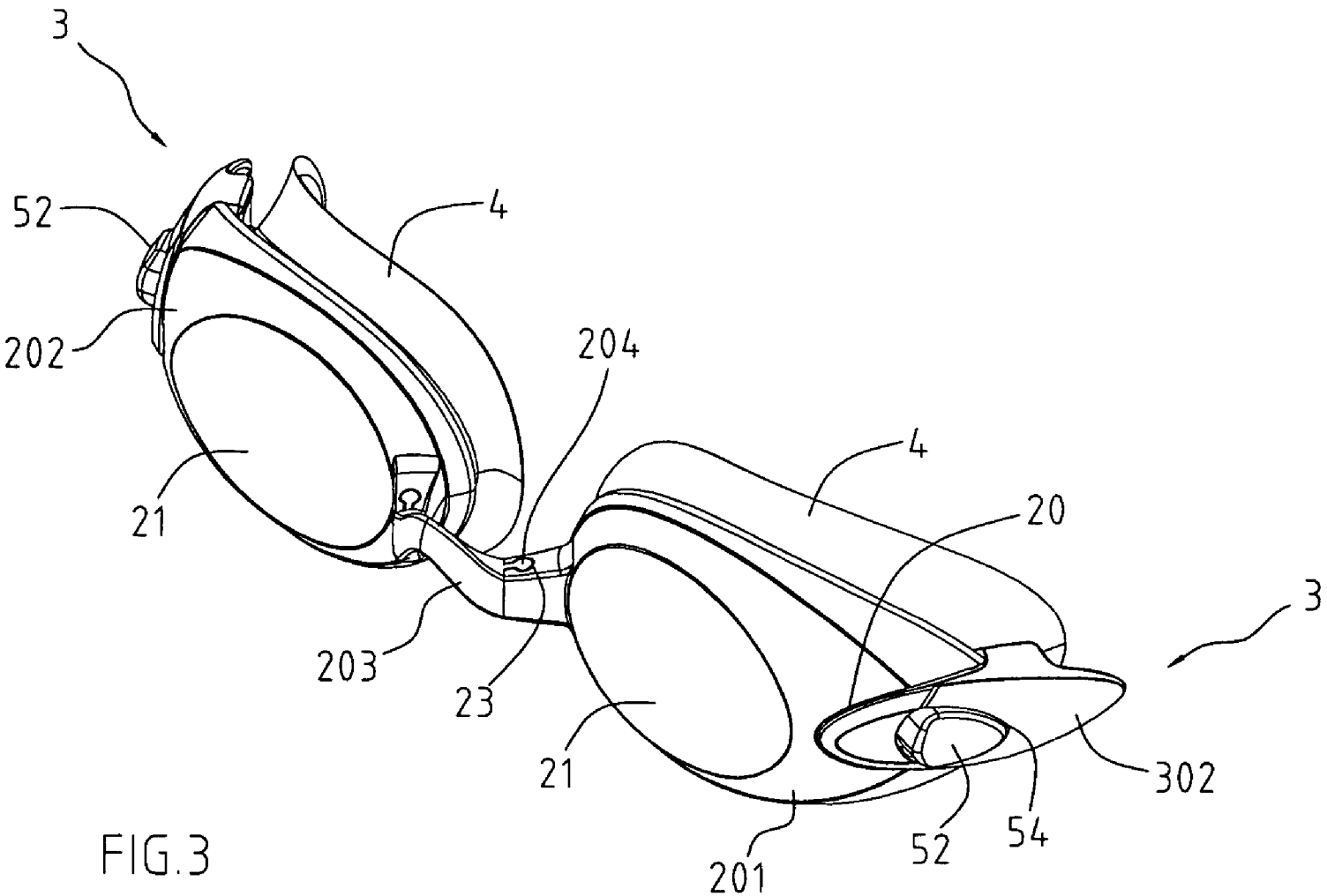
FIG. 3 is an assembled view of the swimming goggles of FIG. 1.

Each strap adjusting device 5 is assembled between the first cover 301 and the second cover 302, and includes a soft pad 50, a pivot shaft 51, a key 52, an abutting arm 53 and an assembling hole 54. The soft pad 50 is respectively provided on the left frame 201/the right frame 202 and between the first latching post 221 and the second latching post 222. The soft pad 50 forms a rectangular protrusion 501 for assembling with the rectangular fixing groove 307, thereby retaining the soft pad 50 onto the first cover 301. The pivot shaft 51 is pivoted onto the axis slot 308 of the first cover 301. The key 52 unitarily and axially extends from a surface of the pivot shaft 51, and covers the soft pad 50. The abutting arm 53 extends from the pivot shaft 51, and is substantially parallel to the key 52 in a way that the abutting arm 53 and the key 52 work in conformity to leverage principle. The abutting arm 53 forms an abutting end 531 near the directing hole 32 in assembly. The assembling hole 54 is defined in the second cover 302. In assembly, the key 52 partially extends beyond the assembling hole 54 for facilitating manual operation, as shown in FIG. 3.

Figure 2:
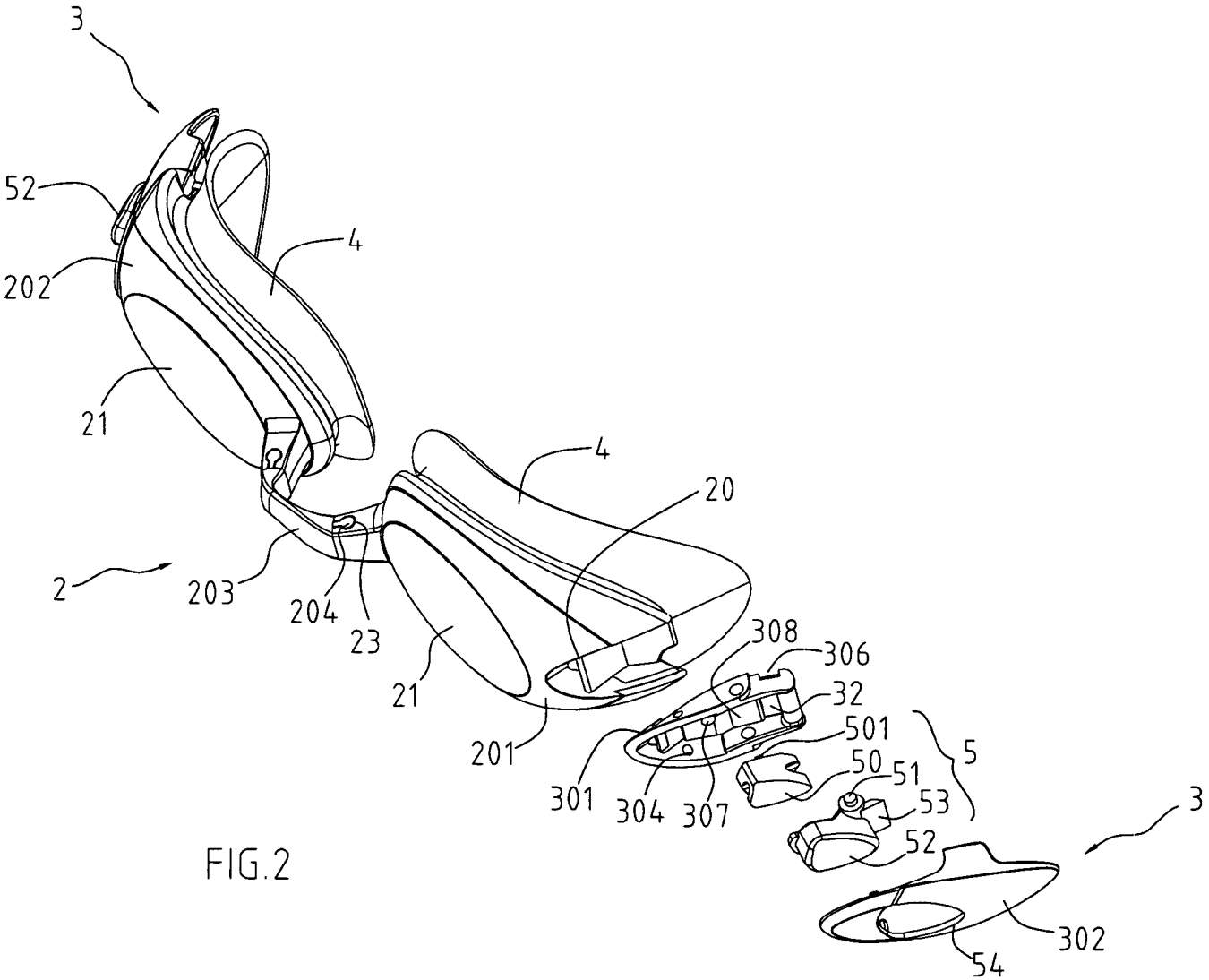
FIG. 2 is a partially assembled view of the swimming goggles, wherein a frame unit thereof is assembled.

During assembly, the assembly of the frame unit 2 and the assembly of the buckle units 3 and the strap adjusting devices 5 can be assembled in individual separate assembly processes and then be assembled together. Referring to FIG. 2, the left frame 201, the right frame 202 and the lenses 21 are integrally shaped, and the protective pads 4 are implanted for shaping. The connecting member 203 connects the left frame 201 and the right frame 202. The soft pads 50, the pivot shafts 51, the keys 52 and the abutting arms 53 are assembled onto the first covers 301. Finally the second covers 302 are secured to the first covers 301.

Figure 4:
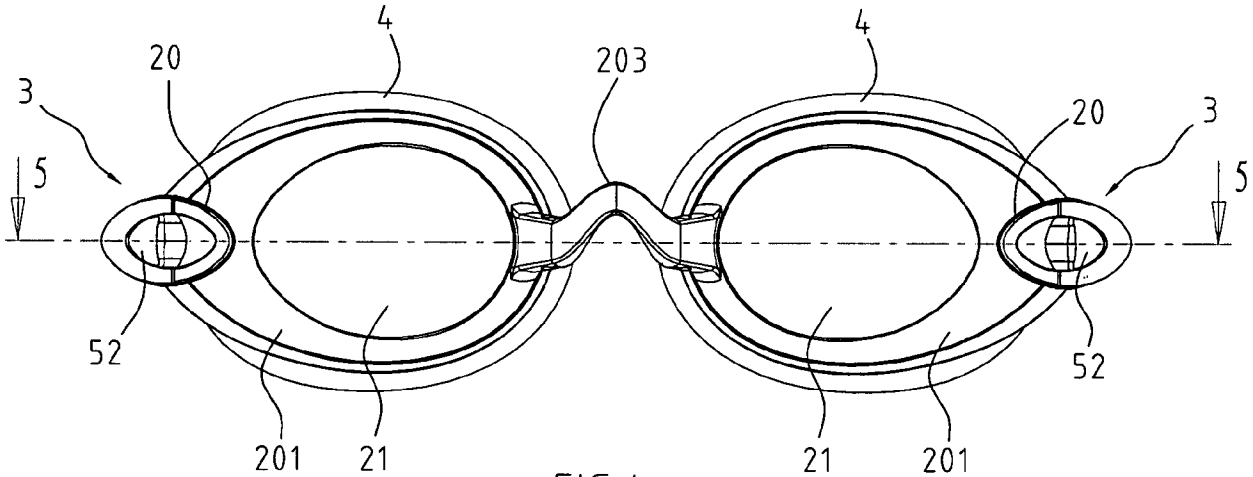
FIG. 4 is a front view of the swimming goggles of FIG. 3.
Figure 7:
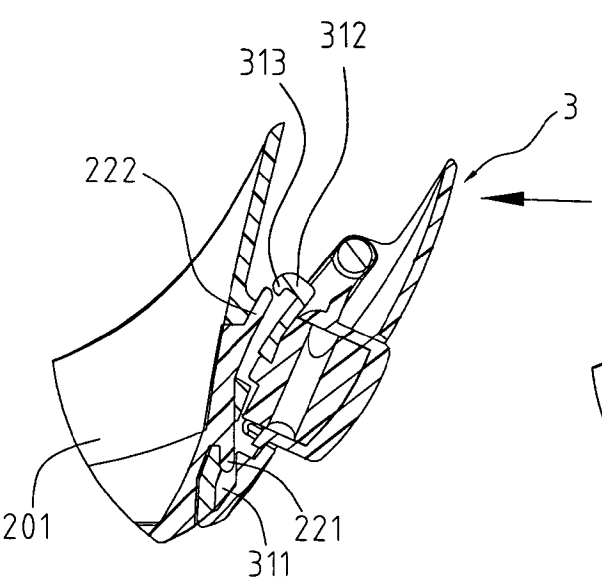
FIG. 7 schematically shows buckle units of the swimming goggles adjusting a head strap.

Referring to FIG. 7, the latching grooves 311 are slantwise extended to lock with the first latching posts 211. The buckle units 3 are slightly inclined, and the J-shaped posts 312 and the second latching posts 222 are perpendicular to each other. The barbs 313 are located on sides of the J-shaped posts 312 and far away from the second latching posts 222. The J-shaped posts 312 are further pressed down as directed by the arrow of FIG. 7. The barbs 313 extend beyond the second latching posts 222 for latching the buckle units 3 on the left frame 201 and the right frame 202. FIGS. 3 and 4 show the assembled swimming goggles. The buckle units 3 have profiles fitting to the recessed portions 20.

When the lenses of the swimming goggles need to be changed in myopic degree or style of the frame unit, the swimming goggles are operated reverse to the assembly order of FIG. 7. The buckle units 3 disassemble from the left frame 201 and the right frame 202. The connecting member 203 is pushed reverse to the notch 231 and the engaging portion 232 (referring to FIG. 1). A new left frame 201 and/or a new right frame 202 are/is easily assembled with the connecting member 203.

Figure 5:
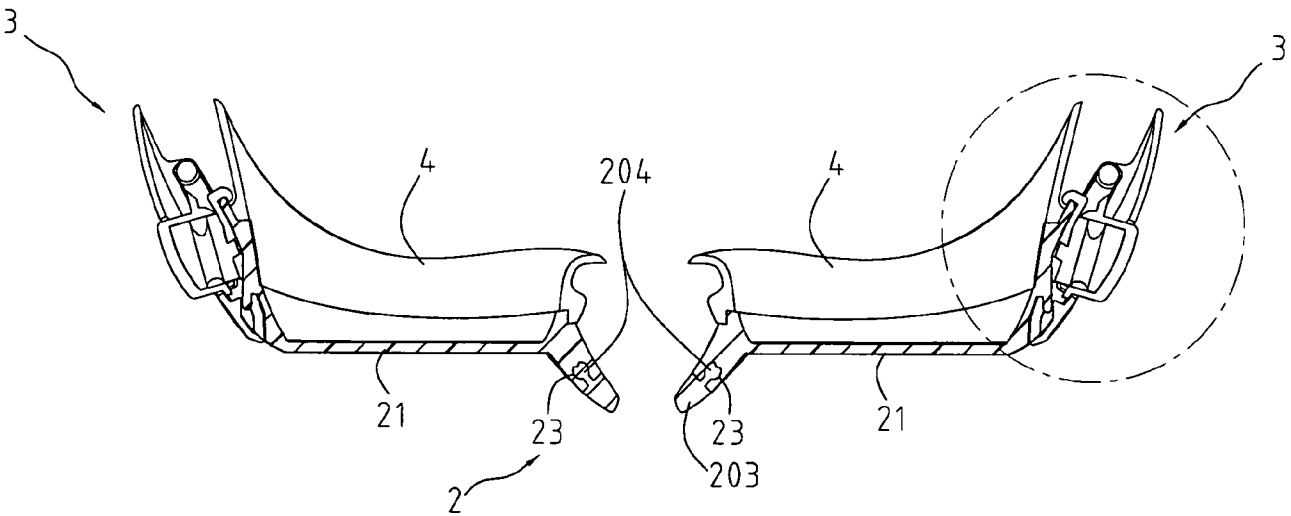
FIG. 5 is a cross-sectional view taken along the line 5-5 in FIG. 4.
Figure 8:
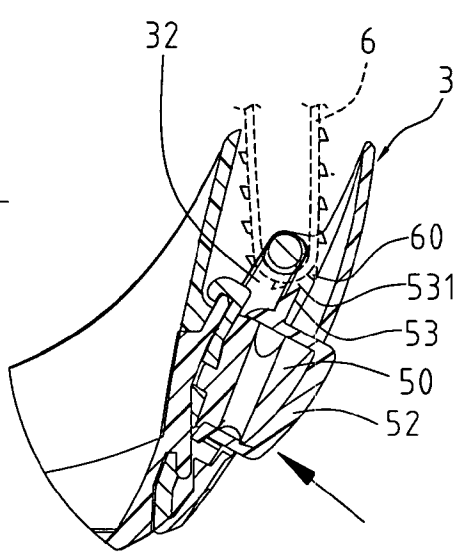
FIG. 8 schematically shows buckle units of the swimming goggles deviating from the frame unit.
Figure 6:
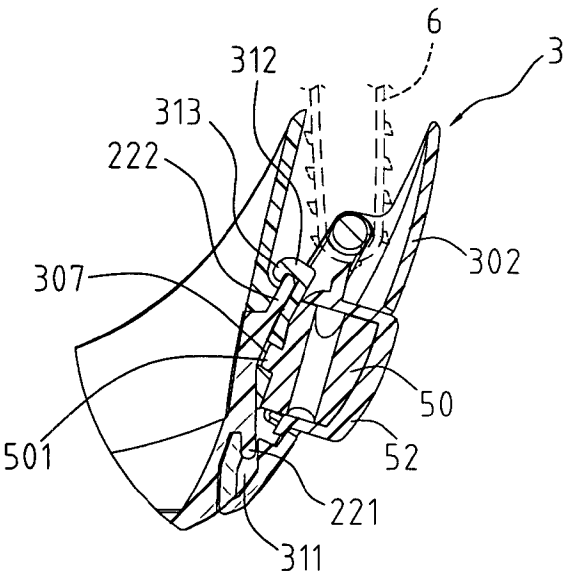
FIG. 6 is a partially enlarged view of FIG. 5.

Further referring to FIGS. 5, 6 and 8, in order to adjust length of the head strap 6, the key 52 is pressed (as the arrow shown in FIG. 8). The abutting arm 53 displaces reverse to the key 52, and the abutting end 531 moves toward far away from the directing hole 32. The head strap 6 defines a plurality of stopping grooves 60 on a free end thereof for abutting against the abutting end 531 of the abutting arm 53. As a result, the stopping grooves 60 of the head strap 6 are released, and the head strap 6 is allowed to be adjusted freely. Once the key 52 is released, the key 52 returns to original position due to flexibility produced by deformation. In such a way the head strap 6 is controllable to adjust length thereof.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. Swimming goggles comprising:

a frame unit including a left frame and a right frame respectively adapted to fit a user's eyes, a connecting member detachably connecting the left frame and the right frame, and lenses respectively assembled on the left frame and the right frame, first connecting portions being provided on sides of the left frame and the right frame;

buckle units and a head strap assembled on the buckle units, each buckle unit including at least a base defining directing holes therein for guiding the head strap, and a second connecting portion for engaging to or disengaging from the first connecting portion;

wherein the connecting member, the first connecting portions and the second connecting portions are able to be assembled and disassembled such that the connecting member and the buckle units are assembled to or disassembled from the left frame and the right frame, each of the first connecting portions comprises a first latch and a second latch opposing to each other, each of the second connecting portions comprises a first embedding portion and a second embedding portion for respectively engaging to the first latch and the second latch, and wherein the first latch and the second latch are a first latching post and a second latching post which are respectively integrated with each of the left frame and the right frame and are respectively slantwise in relation to each other, the first embedding portion comprises a latching groove in the base and corresponds to the first latch, and the second embedding portion comprises a J-shaped post formed on the base, the J-shaped post forms a barb thereon.

2. The swimming goggles as claimed in claim 1, wherein connecting posts are respectively provided on opposite sides of the connecting member, and embedding grooves are respectively defined in the left frame and the right frame for being assembled with the connecting posts.

3. The swimming goggles as claimed in claim 2, wherein each connecting post includes a neck and a cylindrical expanding portion extending from the neck, and the embedding groove has a notch and a cylindrical engaging portion, in assembly, the neck and the cylindrical expanding portion being extended through the notch to engage the cylindrical engaging portion.

4. The swimming goggles as claimed in claim 1, wherein the J-shaped posts and the second latching posts are perpendicular to each other, the barbs being located on sides of the J-shaped posts and far away from the second latching posts, when the J-shaped posts are pressed down, the barbs extend beyond the second latching posts for latching the buckle units with the left frame and the right frame.

5. The swimming goggles as claimed in claim 4, wherein recessed portions are respectively defined in sides of the left frame and the right frame for fitting to profiles of the bases of the buckle units.

6. The swimming goggles as claimed in claim 5, wherein the base comprises a first cover and a second cover assembled together, the first cover having the latching grooves, J-shaped posts and directing holes, the second cover acting as a panel of shaping.

7. The swimming goggles as claimed in claim 6, further comprising strap adjusting devices, each strap adjusting device being assembled between the first cover and the second cover, and including a soft pad, a pivot shaft, a key, an abutting arm and an assembling hole, the soft pad being respectively provided on the left and right frames and between the first latching post and the second latching post, the pivot shaft being pivoted on the first cover, the key unitarily and axially extending from a surface of the pivot shaft and covering the soft pad, the abutting arm extending from the pivot shaft and being substantially parallel to the key in a way that the abutting arm and the key work in conformity to leverage principle, the abutting arm forming an abutting end near the directing hole, the assembling hole being defined in the second cover, in assembly, the key partially extending beyond the assembling hole for facilitating manual operation, when the key is pressed, the abutting arm displacing reverse to the key, and the abutting end moving toward far away from the directing hole, the head strap being controllable to adjust length thereof.

8. The swimming goggles as claimed in claim 7, wherein the head strap defines a plurality of stopping grooves on a free end thereof for abutting against the abutting end of the abutting arm.

9. The swimming goggles as claimed in claim 7, wherein the first cover defines a rectangular fixing groove between the latching groove and the J-shaped post, and wherein each soft pad forming a rectangular protrusion for assembling with the rectangular fixing groove, thereby retaining the soft pad onto the first cover.

10. The swimming goggles as claimed in claim 1, further comprising protective pads respectively integrated with peripherals of the left frame and the right frame.

11. The swimming goggles as claimed in claim 1, wherein the lenses are integrated with the left frame and the right frame.

* * * * *